United States Patent [19]

Struben et al.

[11] 4,411,109

[45] Oct. 25, 1983

[54] BEAM-BRACED AWNING

[76] Inventors: Francis L. Struben; Jean C. Struben, both of 3870 Jarretsville Pike, Jarrettsville, Md. 21084

[21] Appl. No.: 303,376

[22] Filed: Sep. 18, 1981

[51] Int. Cl.[3] ..... E04D 13/00; E04B 7/04; E04D 13/04

[52] U.S. Cl. ..... 52/11; 52/16; 52/75; 52/92

[58] Field of Search ..... 52/11, 16, 74, 75, 76, 52/77, 78, 90, 93, 105, 92

[56] References Cited

U.S. PATENT DOCUMENTS

| | | | |
|---|---|---|---|
| 3,084,479 | 4/1963 | Struben | 52/90 X |
| 3,100,012 | 8/1963 | Dunn | 52/74 |
| 3,113,434 | 12/1963 | Phillips et al. | 52/11 |
| 3,141,532 | 7/1964 | Runyan | 52/105 |
| 3,286,404 | 11/1966 | Harrison | 52/75 X |
| 3,286,413 | 11/1966 | Wells | 52/16 |
| 3,911,633 | 10/1975 | Bamberger | 52/75 |
| 3,984,951 | 10/1976 | Hindman | 52/90 |
| 4,065,883 | 1/1978 | Thibodeau | 52/11 |
| 4,100,703 | 7/1978 | Sickler | 52/16 |
| 4,261,143 | 4/1981 | Rizzo | 52/16 |
| 4,285,175 | 8/1981 | Struben et al. | 52/90 |

*Primary Examiner*—Alfred C. Perham

*Assistant Examiner*—David J. Thomas

*Attorney, Agent, or Firm*—Walter G. Finch

[57] ABSTRACT

The invention is an improved awning for installation at portable or fixed buildings, including mobile type buildings. The awning is of the rigid type and is provided with a member for affixing to the building which it serves. The invention provides a unique channel-like member for affixing the inboard side of the awning to a building structure; the channel-like member serving as in the inboard side main structural member of the awning. A plurality of uniquely shaped main beams extend from the channel-like member to an outboard member of a flanged channel-like configuration. Pan-like members are fitted between each pair of adjacent main beams to form the roof proper of the awning. The fitting of the pan-like members into the unique shape of the main beams provides a beam-braced awning structure that is very rigid. The outboard ends of the main beams are affixed to the flanged channel-like outboard member, which is suitably supported by columns or posts. A raingutter member of special configuration that provides a face plate for the awning completes the main structure. A special filler piece is provided which fits into the channel-like member along the inboard edge to seal the structure against weather penetration.

9 Claims, 8 Drawing Figures

BEAM-BRACED AWNING

BACKGROUND AND SUMMARY OF THE INVENTION

The invention relates to awnings and in particular to rigid type awnings. Specifically, it relates to awnings for affixing to portable and fixed type buildings.

In the prior art most awnings for attachment to buildings have been limited to non-rigid types, (such as those on a frame which could be raised, or a roll-up type on a pipe-type frame), rigid types utilizing rigid plastics sheets, or rigid types using corrugated metal sheets over a metal frame.

The plastics types normally were limited in the load they could bear and the plastics degraded in sunlight. The corrugated metal sheets were unsightly, and also were limited in load carrying capacity unless they were supported by a heavier load-bearing framework; the framework was also unsightly and required a ceiling covering if the industrial-like appearance was to be improved.

The present invention provides a very rigid structure that is capable of carrying heavy loads, provides a neat appearance, including a neat interior.

The present invention has a unique channel-like means for affixing the inboard side of the awning to a building structure. The channel-like means, has flanges which slope slightly in the direction of the slope of the roof portion of the awning. A unique slotted projection on the outboard end of the top flange provides a means for inserting a leg of a filler piece when the awning is erected so as to seal the inboard end against weather penetration.

At the outboard end the roof portion of the awning it rests on a flanged channel-like girder means. The flanges of the flanged channel-like member are affixed to columns or posts for support. It is to be understood that the support means may also be of a wall-type structure, such a variation is within the scope and intent of the invention.

A plurality of uniquely formed beams extend from, and are supported by, the channel-like means at the inboard end, and by the flanged channel-like girder means at the outboard end. The unique beams have a special projection on each side of the web that extends downward from the top flange of the beam. These projections form a slot-like opening on each side of the web into which a pan-like member is fitted to form the roof portion of the awning. The combination of the pan-like members fitted into the special shaped beams provides a beam-braced awning as the structure of this invention.

An "L" shaped filler piece snaps into the aforementioned slotted projection in the channel-like inboard support means to assist in sealing the pan-like members against the weather at the inboard end.

A uniquely shaped rain-gutter means is affixed to the outboard ends of the plurality of beams that support the pan-like members in a manner so that the rain-gutter means is hidden and so that rain water or melting snow will flow directly from the upturned pan-like member into the rain gutter facility. A unique feature of the rain gutter facility is that it is configured to combine an upturn specially designed leg which is affixed to the extreme outboard end of the beams. The special configuration provides not only a face plate means at the outboard end, but is so arranged that a decorative means can be inserted within it.

Other special features of the components of the structure of the present invention, which facilitate erection of the beam-braced awning, are described in detail hereinafter in the specification of the preferred embodiments.

It is, therefore, an object of this invention to provide an awning that has a unique means of bracing through the beam structure.

It is another object of the invention to provide an awning that is pleasing to the view without an industrial appearance.

It is also an object of the invention to provide an awning that includes a component for affixing to a building and concurrently provides a facility assisting in weatherproofing in assembly.

It is yet another object of the invention to provide an awning that is usable on portable or fixed buildings.

It is still another object of the invention to provide an awning that combines the roofing members with the beam supports to facilitate water run-off.

It is yet still another object of the invention to provide an awning that has a hidden rain gutter means that is combined with the face plate means of the structure.

Further objects and advantages of the invention will become more apparent in light of the following description of the preferred embodiments.

DESCRIPTION OF THE PREFERRED EMBODIMENTS

Figure 1:
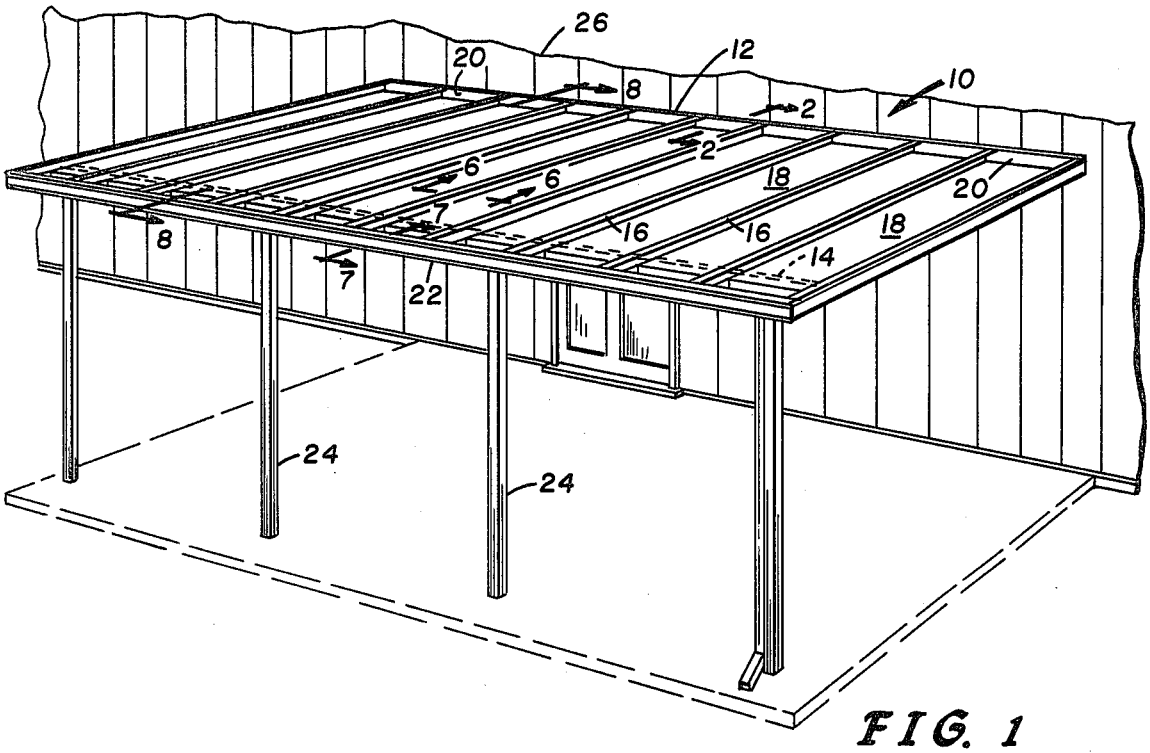
FIG. 1 is a generalized perspective view of a beam-braced awning.
Figure 8:
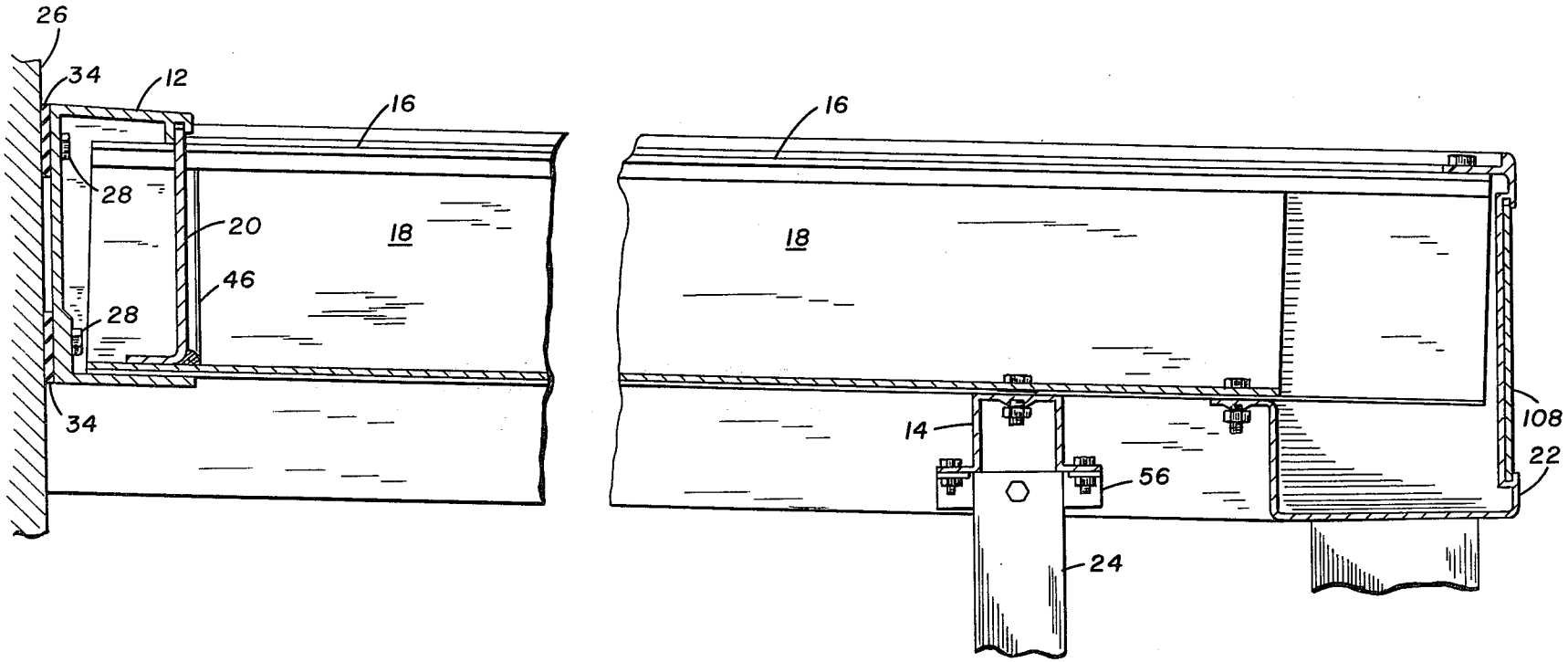
FIG. 8 is a cross sectional view of the beam-braced awning of FIG. 1 on line 8—8.

Referring now to the drawings and particularly to FIG. 1, a beam-braced awning is shown at 10. FIG. 8 shows a cross sectional view through the beam-braced awning of FIG. 1.

The beam-braced awning 10 general structure is composed of wall channel member 12, outboard girder 14, a plurality of beam members 16, a plurality of pan members 18, a plurality of seal members 20, a combined rain gutter and face plate member 22, and a plurality of column members 24. Associated features of the aforementioned components of the beam-braced awning 10 and their cooperation there between are described in detail hereinafter.

Figure 2:
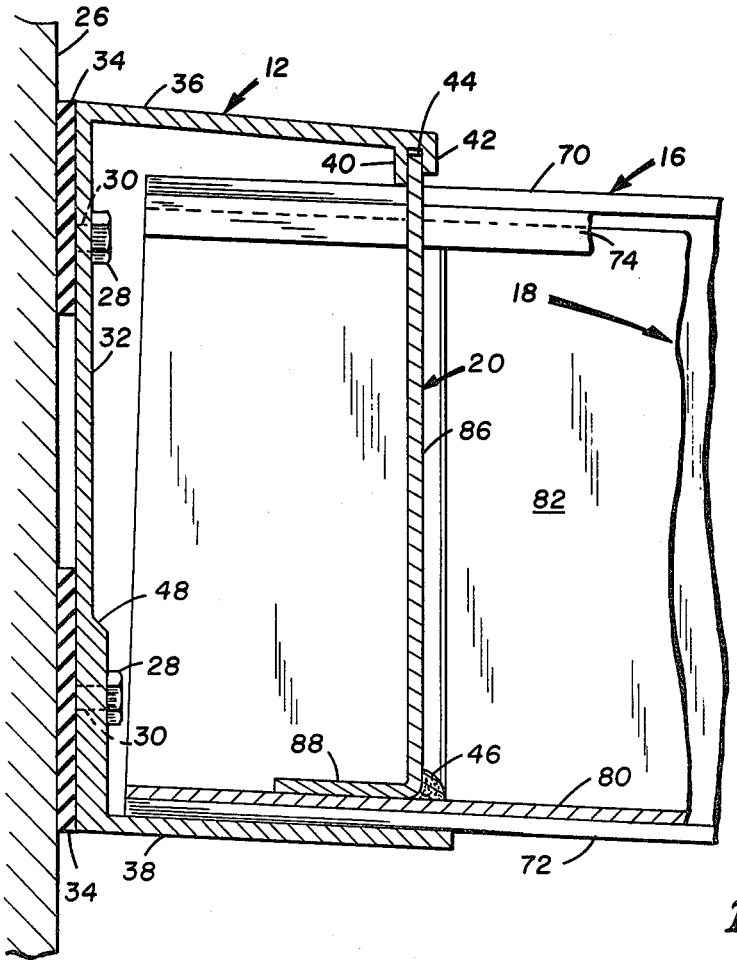
FIG. 2 is an enlarged cross sectional view of a wall attachment member of FIG. 1 on line 2—2.

For the detailed description of the various aforementioned components, the associated unique features of the components, and the cooperation of and between the components, reference is made to the drawings, beginning with FIG. 2.

Wall channel member 12 consists of a web member 32, a top flange 36, and a bottom flange 38. The lower portion 48 of web 32 is of enlarged or increased size for increased strength. Flanges 36 and 38 slope downward slightly, as seen in FIG. 2, to match the normal slope of an awning roof configuration. The aforementioned slope of the flanges 36 and 38, particularly the lower flange 38, provides a close interface between the interior surface of the lower flange 38 of channel 12 and the exterior surface of the bottom of the bottom flange 72 of beam 16.

Wall channel member 12 has two projections, interior projection 40 and exterior projection 42 on the inside or downward surface of the top flange 36. Interior projection 40 is slightly longer than exterior projection 42. The added length is for the purpose of aiding the guiding of the seal member 20 into place in slot or pocket 44 (formed between the spaced apart projections 40 and 42) as later described hereinafter.

The wall channel 12 is affixed to the wall 26 by suitable fastening means 28 (such as lag screws, bolts or similar means) through holes 30 in web 32. A mastic type sealing means 34 is inserted between the channel member 12 and the wall 26 to seal against the weather elements.

Figure 3:
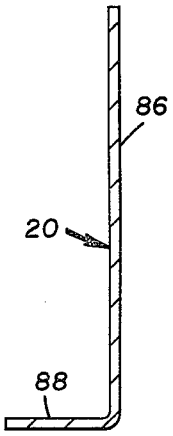
FIG. 3 is an enlarged cross sectional view of a weather shield member of a beam-braced awning.
Figure 4:
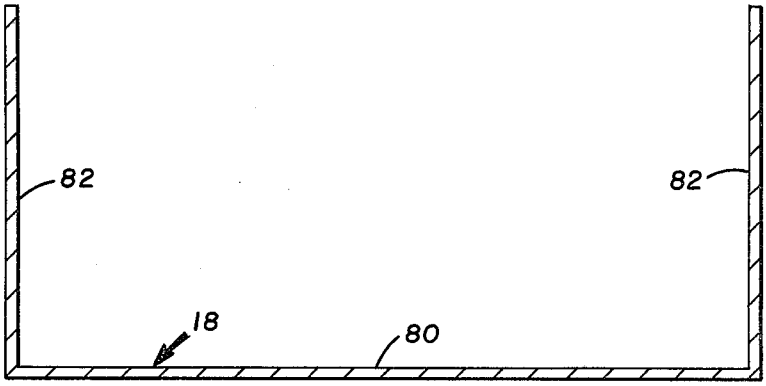
FIG. 4 is an enlarged cross sectional view of a roofing pan member of a beam-braced awning.

Turning now to FIGS. 3 and 4, the configuration of seal member 20 and pan member 18 is shown in detail. Seal member 20 consists of a vertical leg 86 and a horizontal leg 88. Pan member 18 consists of a horizontal member 80 (similar to the web of a channel section) and two vertical members 82 (similar to the flanges of a channel section).

As shown in FIG. 2, the end of vertical leg 86 is inserted into slot 44 by first placing it against the interior projection 40 and sliding it upwardly as the horizontal leg 88 snaps into place along the horizontal member 80 of pan member 18. A mastic type seal means 46 seals the interface of legs 86 and 88 with horizontal member 80 against the weather elements.

Seal member 20 is coped in configuration (not shown) at the sides where its vertical leg 86 meets and interfaces with vertical member 82 of pan member 18 and the upper portions of beam 16. The mastic seal means 46 is extended along the sides of vertical leg 86, where necessary, to assure the aforementioned weather seal. The configuration of seal member 20, including the aforementioned coped configuration, may be predetermined and formed because of the standardized configuration of beam 16 and pan member 18.

Figure 5:
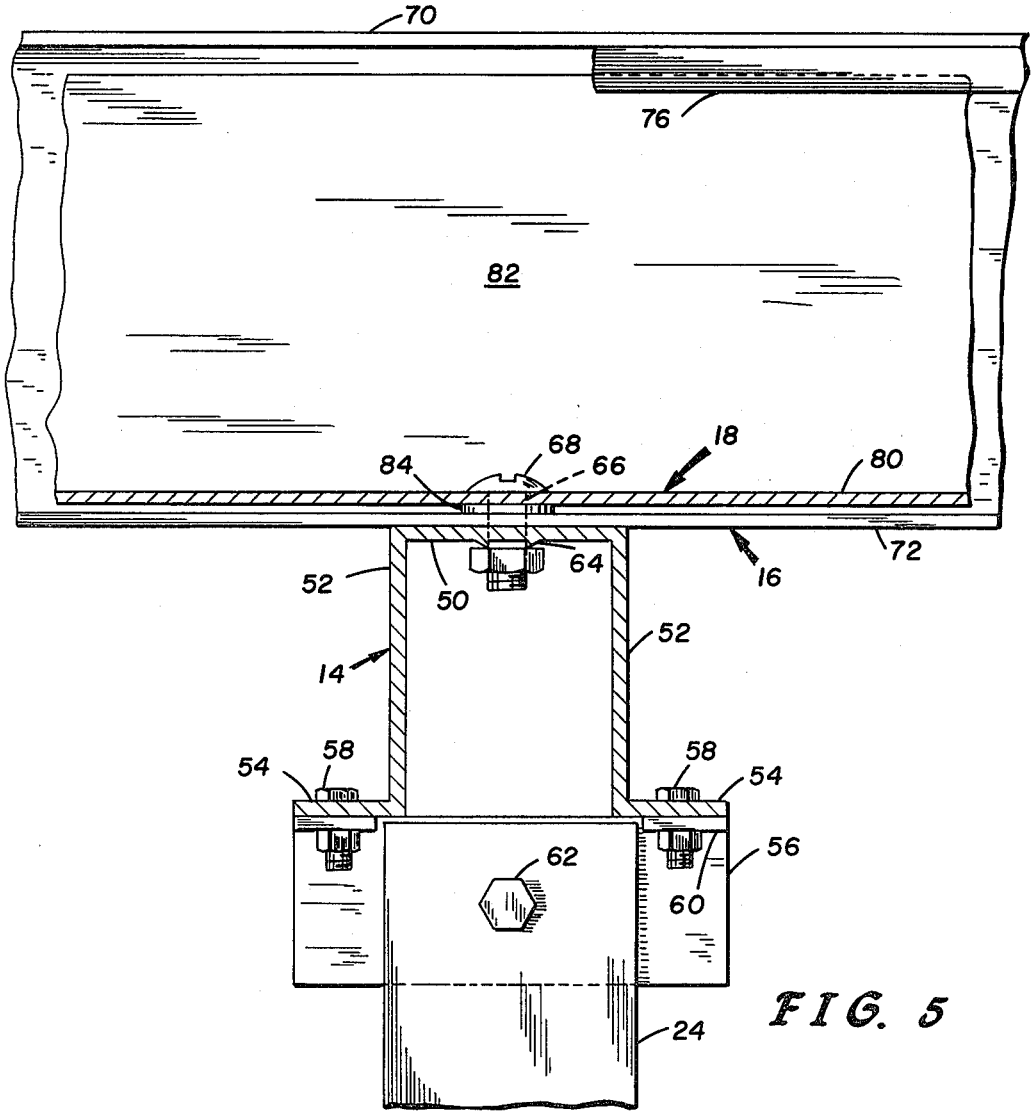
FIG. 5 is an enlarged cross sectional view of a girder member of a beam-braced awning at the outboard edge of the beam-braced awning.

Turning now to FIG. 5, the outboard ends of the plurality of beam members 16 and the plurality of pan members 18 are supported by outboard girder member 14. Thus, the combined structure of the plurality of beam members 16 and the plurality of pan members 18 is supported at the inboard end by wall channel member 12 and at the outboard end by girder member 14. The girder member 14 being supported by a plurality of column members 24.

The girder member 14 consists of a web 50, flanges 52 from each end of web 50, and special outwardly turned flanges 54 from the distal ends of the flanges 52. A pair of ribs 64 run the length of the girder member 14. The ribs 64 are on the "inside" of the girder member 14. The pair of ribs 64 serve as a guide means for locating a drill means to drill hole 66 through the web 50, the lower flange 72 of beam 16, and the bottom or horizontal member 80 of the pan member 18, in order to insert a suitable connecting or attaching means 68. The attaching or connecting means may be a bolt and nut, self-tapping screw, rivet, or other suitable means for affixing the components to each other.

Depending upon the assembly, the underside surface of the horizontal web 80 of pan member 18 may be installed interfacing with the top surface of the lower flange 72 of beam 16. If the pan member 18 is located above the flange 72, a spacer or filler means 84 may be inserted between web 80 and flange 72.

A clip means 56 is provided to affix the girder member 14 to each column or post means 24. Clip means 56, as shown in the drawings, has a pair of legs 60 extending therefrom to facilitate affixing the clip means 56 to the girder means 14 with suitable attaching or connecting means 58 (such as bolt and nut, rivets, or similar means). The clip means 56 is then affixed to the column or post 24 by a suitable attaching or connecting means 62 (such as a bolt or rivet or similar means).

It is to be understood that although a channel-like column or post means 24, and a simple angle-like clip means 56 is shown in the drawings, that a square or round post or column means, or any other configuration, with a plate or other means across the top for connecting to the girder member 14 is within the scope and intent of this invention.

Figure 6:
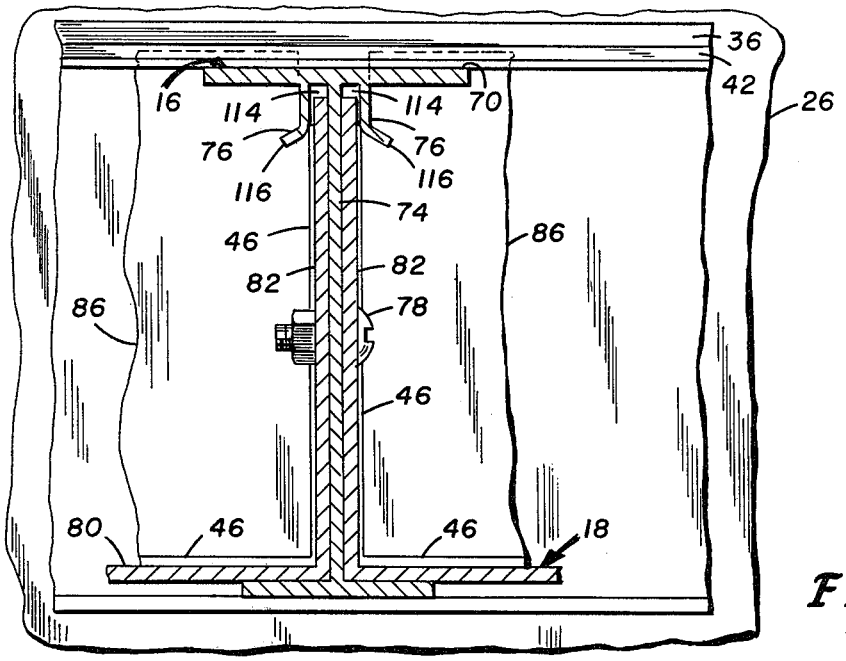
FIG. 6 is an enlarged partial cross sectional view of components forming the beam-braced structure of a beam-braced awning of FIG. 1 on line 6—6.

Referring to FIG. 6, an enlarged drawing of the beam 16 illustrates how pan members 18 are affixed thereto to provide the general structure of the beam-braced awning.

Referring to FIGS. 1 and 6, after the wall channel 12 is erected on the building 26, and the girder member 14 is erected on columns 24 (either in permanent position or by a temporary set-up pending installation of the awning 10 roof portion), the main roof portion of awning 10 is ready for installation or erection, as will be described hereinafter.

Beam member 16 consists of a web 74 with a top flange 70 and a bottom flange 72, and two projections 76 from the underside of the top flange. One of the projections 76 is located on each side of the web as shown in FIG. 6. The two projections 76 are each spaced from the web 74 so as to form slots or pocket 114, on pockets 114 on each side of web 74.

The ends 116 of projections 76 are bent or canted outwardly away from the web 74. The canted or bent ends 116 assist in the insertion of the upstanding or vertical legs 82 into the pockets 114 as hereinafter described.

Once the pan members 18 are installed with the vertical legs 82 (of adjacent pan members 18) inserted into the pockets 114 (one leg 82 on each side of web 74) and the pan member 18 is set in position, the combined set of the web 74 of a beam member 16 and the upstanding or vertical legs 82 of adjacent pan members 18 are aligned into position, the combination is drilled through for the insertion of attachment, connecting, or affixing means 78. It is to be noted that the drilling of holes for the connecting means 78 may be made in the field during installation, or the position may be predetermined for drilling in the shop.

The optional field drilling or shop drilling mode of assembly is also applicable to the aforementioned drilling for connecting means 68 or for connecting means 94 described hereinafter. The drilling for connecting means 28 and 58, described hereinbefore, and for connecting means 102 described hereinafter, may also be field drilled or predetermined and drilled in the shop.

In assembling the roof portion of the awning 10, the assembly may begin with either beam member 16 or pan member 18. As an example, starting with a pan member 18, one end of the pan member 18 is inserted into the wall channel member 12 and the other end is laid or rested upon the top of girder member 14. Next one end of a first beam member 16 is inserted into the wall channel member 12 and the other end also rested on the girder member 14. The vertical leg 82 is inserted into the pocket 114, using the bent end 116 to assist in guiding the leg 82 into place.

The next step is to insert one end of a second pan member 18 into the wall channel member 12 and rest the other end upon the girder member 14, this second pan member 18 is located on the opposite side of the first beam member 16 from the first pan member 18. The vertical leg 82 of second pan member 18, which is next to the first beam member 16, is then inserted into the pocket 114 on its side of beam member 16 in the same manner as the vertical leg 82 of the first pan member 18 was inserted. When the beam member 16 and the two pan members 18 are aligned in true position, the components are affixed to each other by connecting means 78 as hereinbefore described. The assembled members are also affixed to the girder member 14 by connecting means 68 as hereinbefore described. Thus, this is the first step in assembling the roof portion of the beam-braced awning 10.

Then in successive steps the next beam member 16 is assembled to the second pan member 18, and a third pan member 18 is assembled to the opposite side of the beam member 16. This process is repeated until all beam members 16 and pan members 18 for the roof portion have been assembled and affixed into place.

Although not shown in the drawings, each of the beam members 16 and pan members 18 combinations are also affixed to the wall channel member in a manner similar to the connection made at the girder member 14. At the girder member 14, if desired, the pan members 18 may be affixed to the girder member 14 instead of connecting through the beam member 16. Thus, this flexibility of making the connections that affix the various components into a structural assembly may be varied within the scope and intent of the invention without affecting the uniqueness or the effectiveness of the beam-braced awning structure.

It is to be noted that at each end of the beam-braced awning that the awning may be provided a finished appearance by filling in the open side of the first and last beam members 16 with a false insert (not shown). However, a channel-like member (not shown) instead of the "I" shaped beam member 16, may be used for the first and last beam members used in the structure. In this case the channel-like member would have the projection 76 on the underside of the top flange on the side that would provide for the insertion and connection of the adjacent pan member 18. This variation is within the scope and intent of the invention though not illustrated.

Figure 7:
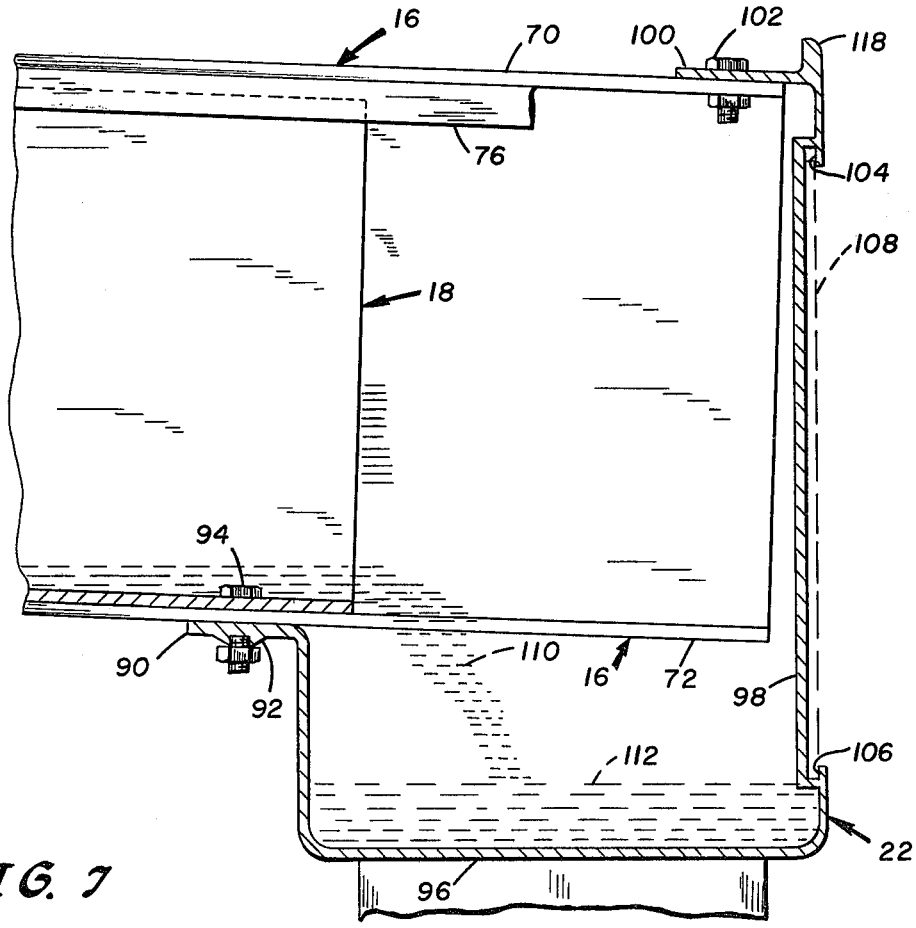
FIG. 7 is an enlarged cross sectional view of the assembly of components at the outboard end of the beam-braced awning of FIG. 1 on line 7—7.

Turning now to FIG. 7, after the beam-braced awning 10 is assembled as hereinbefore described, the combined rain gutter and face plate member 22 is assembled and affixed to the structure.

The combined rain gutter and face plate member 22 consists of a bottom connecting flange 90, a rain gutter portion 96, a vertical face plate portion 98, and a top connecting flange 100.

The bottom connecting flange 90 has two ribs 92 running the longitudinal length of the rain gutter and face plate member 22. These ribs 92 are spaced apart and serve as a guide means for drilling through the rain gutter and face plate member 22, the beam member 16 and the pan member 18 to provide a hole for the connecting means 94 to affix the rain gutter and face plate member to the assembly at the bottom or lower end.

Note that both the beam member 16 and the pan member 18 extend past the girder member 14, and the beam member 16 extends beyond the pan member 18. The beam member 16 extends to a point that permits the underside of top connecting flange 100 to be interfaced with the top side of flange 70 of the beam member 16. In this position the top connecting flange 100 and the flange 70 of beam member 16 are drilled for the insertion of connecting means 102. Note that the raised end 118 of the vertical face plate portion 98 shields the connecting means 102 from view at ground level. Note, also, that the pan member 18 extends just far enough so that rain water or melting snow 112 will flow 110 from the pan members 18 into the rain gutter portion 96 to be carried away to suitable downspouts for disposal.

It is to be noted that the wall channel member 12, the outboard girder member 14, the beam members 16, the pan members 18, the weather seal members 20, and the rain gutter and face plate member 22 are each monolithically formed, but it is to be understood that they may be fabricated.

On the outer or exposed surface of the rain gutter and face plate member 22, the configuration serves not only as a face plate, the vertical face plate portion 98, but is configured to permit insertion of a decorative panel 108. Note that the major portion of the vertical portion 98 is offset and spaced apart from the end portions at the top and bottom. This creates a pocket or slot 104 at the top and a pocket or slot 106 at the bottom. It is into these pockets that a decorative panel 108 may be inserted.

The decorative panel 108 may be of any desired design, color, or other desirable attributes. In commercial installations, the decorative panel 108 facility may also be utilized for the insertion of sign panels, similar in size to the decorative panel 108.

Thus, the combination and assembly of the aforementioned components cooperate to form the structure of a beam-braced awning 10. The beam members 16 bracing the pan members 18 forming the roof portion, and the pan members 18 in turn laterally bracing the beam members 16.

As can be readily understood from the foregoing description of the invention, the present structure can be configured in different modes to provide the ability to form a beam-braced awning with the unique features described herein.

Accordingly, modifications and variations to which the invention is susceptible may be practiced without departing from the scope of the appended claims.

What is claimed is:

1. An awning, comprising:

a wall support means, said wall support means being substantially channel-like in configuration, said channel-like wall support means having a web and top and bottom flanges, said channel-like wall support means being suitably affixed to a wall through said web, said web being reinforced by increased thickness at the lowermost portion thereof, said top and bottom flanges being canted downwardly from said web, said top flange having a first and second downwardly projecting protrusions, said first downwardly projecting protrusion being located at the distal end of said top flange, said second downwardly projecting protrusion being longer than and spaced apart from said first downwardly projecting protrusion, said downwardly projecting protrusions extending the entire length of said wall support means, said spaced apart protrusions forming a pocket means thereby;

an outboard support means;

a plurality of beam means, said plurality of beam means being spaced apart and supported by and suitably affixed in place to said wall support means and said outboard support means, said plurality of beam means each being generally of an "I" configuration, said "I" configuration consisting of a vertical web and a top and bottom flange, each said beam means having two downwardly projecting protrusions, one of said two protrusions being located on each side of and spaced from said web of said beam means, thereby forming a pocket means on each side of said web, said downwardly projecting protrusions being flanged outwardly at the tips thereof, said downwardly projecting protrusions extending the entire length of said beam means;

a plurality of roof cover means, each said roof cover means of said plurality of roof cover means being partially inserted into said pocket means of each said beam means and then suitably affixed to the respective beam means;

a plurality of rigid sealing means, each said rigid sealing means of said plurality of rigid sealing means being partially inserted into said pocket means formed by said downwardly projecting protrusions of said wall support means and suitably affixed into place; and a combined rain gutter and face plate means, said combined rain gutter and face plate means being suitably affixed to the outboard ends of said plurality of said beam means.

2. An awning as recited in claim 1, wherein said outboard support means is channel-like, said channel-like outboard support means having additional outwardly extending flanges from the extremities of the flanges of said channel-like outboard support means, said channel-like outboard support means having a pair of parallel longitudinal rib-like projections on the inside face of the web of said channel-like outboard support means, said rib-like projections extending the entire length thereof, and additionally, a plurality of column-like means, said plurality of column-like means, supporting said channel-like outboard support means, said outboard support means being suitably affixed thereto.

3. An awning as recited in claim 2, wherein said wall support means, said outboard support means, each said beam means, each said cover means, each said rigid seal means, and said rain gutter and cover plate means, are each monolithically formed as a one piece unit configured as described.

4. An awning as recited in claim 3, wherein said rain gutter and face plate means has a rain gutter portion and a face plate portion, said rain gutter portion receiving run-off of liquid weather elements discharged from said roof cover means, said face plate portion covering the exposed ends of said beam means, said rain gutter portion having an external lower flange projection extending toward said wall support means, said face plate portion having an internal upper flange projection extending toward said wall support means, said rain gutter and face plate means having a pair of parallel longitudinal rib-like projections on said lower flange projection thereof, said rib-like projections extending the entire length of said lower flange projection of said rain gutter and face plate means, all monolithically formed.

5. An awning as recited in claim 4 and additionally, a vertical external projection, said vertical external projection being suitably affixed at the outward end of said internal upper flange projection.

6. An awning as recited in claim 1, and additionally mastic type seal means inserted between said wall support means and said wall, said seal means sealing against penetration by weather elements.

7. An awning as recited in claim 1, wherein said plurality of roof cover means are each channel-like in configuration, said channel-like configuration consisting of a web member and a pair of flange members, said flange members being perpendicularly affixed to and at each side of said web member, each said roof cover means being individually located next to and between adjacent spaced apart said beam means, said beam means bracing said roof cover means and concurrently said roof cover means laterally bracing said beam means to create a beam-braced awning.

8. An awning as recited in claim 7, wherein said plurality of rigid sealing means are each "L" shaped in configuration, said "L" shaped configuration consisting of a long leg perpendicularly affixed to a short leg, said long leg having the distal end thereof inserted into said pocket means formed by said downwardly projecting protrusions, said rigid sealing means thereby being located within the channel-like roof cover means, and additionally a mastic seal means, said mastic seal means being applied at the interface of said rigid sealing means with said roof cover means.

9. An awning as recited in claim 8, wherein the distal ends of said flange members of said plurality of roof cover means are fitted into said pocket means formed by said downwardly projecting protrusions of said wall support means by utilizing said outwardly flanged tips to guide said distal ends of said flange members into said pocket means, said distal end of said long leg of each said "L" shaped rigid sealing means is fitted into said pocket means formed by said downwardly projecting projections by utilizing the side of said longer second downwardly projecting protrusion to guide said distal end of said long leg into said pocket means, said short leg thereafter being snapped into place by interfacing with a respective said web of said roof cover means.

* * * * *